US008196678B2

(12) United States Patent
Jeffryes

(10) Patent No.: US 8,196,678 B2
(45) Date of Patent: Jun. 12, 2012

(54) METHOD OF DOWNLINKING TO A DOWNHOLE TOOL

(75) Inventor: Benjamin Jeffryes, Histon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 277 days.

(21) Appl. No.: 12/562,183

(22) Filed: Sep. 18, 2009

(65) Prior Publication Data

US 2010/0084192 A1 Apr. 8, 2010

(30) Foreign Application Priority Data

Oct. 7, 2008 (GB) ..... 0818250.3

(51) Int. Cl.
*E21B 44/00* (2006.01)

(52) U.S. Cl. ..... 175/38; 175/40

(58) Field of Classification Search ..... 175/25, 175/38, 40, 57; 340/854.3, 855.4; 367/83
See application file for complete search history.

(56) References Cited

U.S. PATENT DOCUMENTS 4,733,233 A 3/1988 Grosso et al.
6,920,085 B2 * 7/2005 Finke et al. ..... 367/83
2008/0007423 A1 * 1/2008 Krueger et al. ..... 340/854.5

FOREIGN PATENT DOCUMENTS

GB 2333787 A 8/1999

OTHER PUBLICATIONS

Bourgoyne et al., "Applied drilling engineering," Society of Petroleum Engineers, SPE Textbook Series, vol. 2, 1986, p. 147 (contents pages of book also supplied).

* cited by examiner

*Primary Examiner* — Giovanna Wright
*Assistant Examiner* — Richard Alker

(57) ABSTRACT

A method of downlinking to a downhole tool located in a borehole is provided. The downhole tool detects transitions in the flow velocity of fluid circulating in the borehole at the downhole tool. To provide for the detection of the transitions fluid is pumped into the drillstring so that it circulates in the borehole at the downhole tool and the the pumping rate of fluid into the drillstring is either increased to a rate which overshoots a steady state pumping rate needed to produce a transition or is decreased to a rate which undershoots a steady state pumping rate needed to produce a transition.

12 Claims, 4 Drawing Sheets

METHOD OF DOWNLINKING TO A DOWNHOLE TOOL

FIELD

The present invention relates to a method of downlinking to a downhole tool located in a borehole.

BACKGROUND

The bottom end of a drillstring has a bottom hole assembly (BHA). The BHA includes a drill bit and typically also sensors, control mechanisms, and associated circuitry. The sensors may measure properties of the formation and of the fluid that is contained in the formation. A BHA may also include sensors that measure the BHA's orientation and position.

The drilling operation is controlled by an operator at the surface. The drillstring is rotated at a desired rate by a rotary table, or top drive, at the surface, and the operator controls the weight-on-bit and other operating parameters of the drilling process.

Drilling fluid, or "mud", is pumped from the surface to the drill bit by way of the drillstring. The mud serves to cool and lubricate the drill bit, and to carry the drill cuttings back to the surface. The density of the mud is carefully controlled to maintain the hydrostatic pressure in the borehole at desired levels.

In order for the operator to be aware of the measurements made by the sensors in the BHA, and for the operator to be able to control the operation of the drill bit, communication between the operator and the BHA is necessary. A downlink is a communication from the surface to tools comprising part of the drillstring, typically within the BHA. A downlink might typically command a change of parameters for a rotary steerable system, intended to modify the curvature or direction in which the hole is progressing, or the operational parameters of downhole sensing tools. Likewise, an uplink is a communication from the BHA to the surface. An uplink is typically a transmission of the data collected by the sensors in the BHA. For example, the data may provide the BHA orientation. Uplink communications are also used to confirm that a downlink command was correctly understood.

One common method of communication is called "mud pulse telemetry". Mud pulse telemetry involves sending signals, either downlinks or uplinks, by creating pressure and/or flow rate pulses in the mud. These pulses may be detected by sensors at the receiving location. For example, in a downlink operation, a change in the flow rate of the mud being pumped down the drillstring may be detected by a sensor in the BHA. The pattern of the pulses may be detected by the sensors and interpreted as a command for the BHA.

A commonly used technique for downlinking includes timed variation of pump speed. The downhole tool either counts transitions from high speed flow to low speed flow (and vice versa) or measures the time between certain transitions.

However, pump adjustments made at the surface are not immediately detected downhole. This is a consequence not principally of wave speed, but a combination of pressure drops and fluid compliance. Further, it is usually necessary to ensure that pump speed variations do not lead to changes in surface flow rates or pressure which exceed safety limits

SUMMARY

Embodiments of the present invention are at least partly based on the recognition that reduced detection times can be achieved by adjusting pump rates to take account of factors such as fluid compliance. The adjusted rates can be arranged to avoid changes in fluid pressure which exceed safety limits.

Thus a first aspect of the invention provides a method of downlinking to a downhole tool (such as an element of a bottom hole assembly) located in a borehole, wherein the downhole tool detects transitions in the flow velocity of fluid circulating in the borehole at the downhole tool, the method including the steps of:

(a) pumping fluid into a drillstring to circulate fluid in the borehole at the downhole tool;

(b) increasing the pumping rate of fluid into the drillstring to a rate which overshoots a steady state pumping rate needed to produce a transition which the downhole tool will detect, or decreasing the pumping rate of fluid into the drillstring to a rate which undershoots a steady state pumping rate needed to produce a transition which the downhole tool will detect; and (c) subsequently adjusting the pumping rate of fluid into the drillstring to approach or achieve said steady state pumping rate;

wherein steps (b) and (c) produce a transition which is detected by the downhole tool.

Using this method, the transition detected by the downhole tool can be achieved much more rapidly than is possible with conventional flow sequences.

Typically steps (b) and (c) are performed twice in sequence, firstly for one of overshoot and undershoot, and secondly for the other of overshoot and undershoot. Indeed, steps (b) and (c) can be performed repeatedly to produce corresponding transitions which are detected by the downhole tool.

As a result of detecting the transition or transitions, the downhole tool may alter its mode of operation.

Preferably, the increased or decreased pumping rate is optimised within operational limits associated with the borehole to minimise the time required to effect the detected transition. In this way, the fastest transition compatible with safe drilling operations can be achieved.

The method may include the step of calculating the steady state pumping rate and the increased or decreased pumping rate before performing step (b). For example, the calculation may be based on any one or any combination of: the compliance per unit length of the fluid circulating within the drillstring, the frictional pressure drop in the drillstring, the ratio of the frictional pressure drop at the downhole tool, and a characteristic time for the circulating fluid to respond to changes in pumping rate. Preferably, the calculation is based at least on said characteristic time, and the method further includes the preliminary step of determining said characteristic time by temporarily stopping the pumping of fluid into the drillstring.

The method may further include the steps of: measuring the surface pressure variation of the fluid after performing steps (b) and (c), comparing the measured pressure variation to a predicted surface pressure variation of the fluid, and adjusting the increased or decreased pumping rate and/or the steady state pumping rate before repeating steps (b) and (c). The adjustment may not necessarily be to the value of, for example, the increased or decreased pumping rate, but may include the period of time that the increased or decreased pumping rate is maintained. Typically the adjustment has the aim of increasing the over- or undershoot if the measured surface pressure variation is lower than predicted, or to decreasing the over- or undershoot if the measured surface pressure variation is higher than predicted. Further aspects of the invention respectively provide a computer system, a computer program and a computer program product which correspond to the method of the first aspect. Moreover, optional features of the first aspect result in corresponding optional features of these further aspects.

Thus, a second aspect of the invention provides a computer system for controlling a pumping system that pumps fluid into a drillstring to circulate fluid to a downhole tool located in a borehole, and being operable to effect transitions in the flow velocity of the circulating fluid which are detectable at the downhole tool to enable downlinking to the downhole tool;

the system being adapted to calculate:

(a) a steady state pumping rate into the drillstring needed to produce a transition which the downhole tool will detect, and (b) either an increased pumping rate of fluid into the drillstring which overshoots said steady state pumping rate, or a decreased pumping rate of fluid into the drillstring which undershoots said steady state pumping rate;

the system further being adapted to issue control signals for controlling the pumping system to:

(i) adjust the pumping rate to said increased or decreased pumping rate, and (ii) subsequently adjust the pumping rate of fluid to approach or achieve said steady state pumping rate;

wherein, in use, the adjustments produce a transition which is detectable by the downhole tool.

The system may be adapted to perform further calculations and to issue corresponding further control signals for controlling the pumping system, so that further transitions can be produced which are detectable by the downhole tool.

The system may be adapted to receive operational limits associated with the borehole, and the calculated increased or decreased pumping rate can be optimised within said operational limits to minimise the time required to effect the detectable transition.

A third aspect of the invention provides a pumping system for a borehole, the pumping system having the computer system according to the second aspect for enabling downlinking to a downhole tool located in the borehole.

A fourth aspect of the invention provides a computer program for controlling a computer-controlled pumping system that pumps fluid into a drillstring to circulate fluid to a downhole tool located in a borehole, and being operable to effect transitions in the flow velocity of the circulating fluid which are detectable at the downhole tool to enable downlinking to the downhole tool;

the computer program, when executed, calculating:

(a) a steady state pumping rate into the drillstring needed to produce a transition which the downhole tool will detect, and (b) either an increased pumping rate of fluid into the drillstring which overshoots said steady state pumping rate, or a decreased pumping rate of fluid into the drillstring which undershoots said steady state pumping rate;

the computer program, when executed, further issuing control signals for controlling the pumping system to:

(i) adjust the pumping rate to said increased or decreased pumping rate, and (ii) subsequently adjust the pumping rate of fluid to approach or achieve said steady state pumping rate;

wherein, in use, the adjustments produce a transition which is detectable by the downhole tool.

A fifth aspect of the invention provides a computer program product carrying the computer program of the fourth aspect.

BRIEF DESCRIPTION OF THE DRAWINGS

Embodiments of the invention will now be described by way of example with reference to the accompanying drawings, in which.

DETAILED DESCRIPTION

Figure 1:
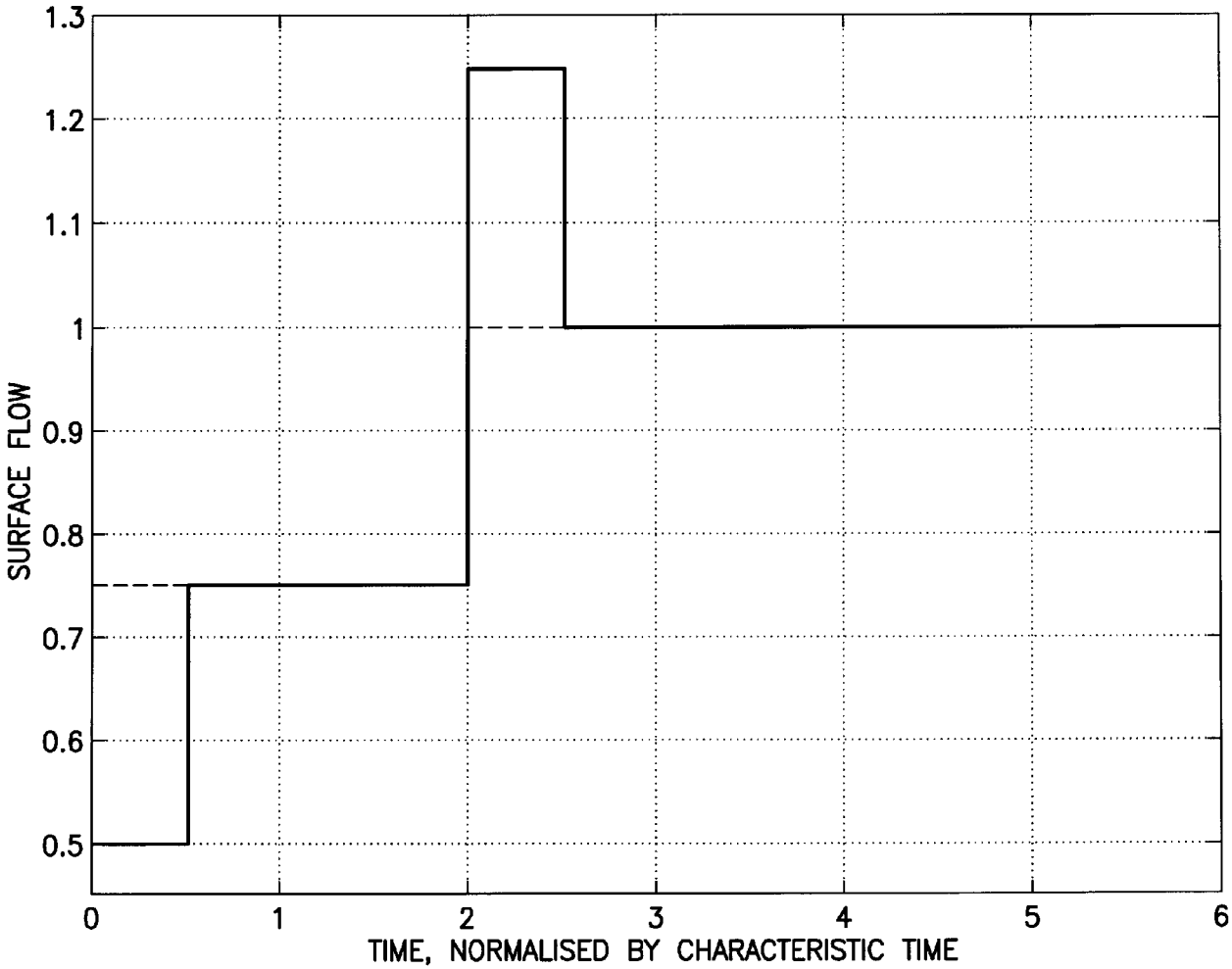
FIG. 1 shows surface flow rates against time for a conventional downlinking flow sequence (dashed line) and a downlinking flow sequence according to an embodiment of the present invention (solid line)

In order to optimise the amount of overshoot or undershoot to improve downlink times it is helpful first to estimate parameters associated the borehole so that the effects downhole of surface flow changes can be modelled.

The compliance per unit length $\Lambda$ of the fluid circulating within the drillstring is generally known, or varies only within a defined range. The compliance per unit length of the fluid is the cross sectional area of the fluid within the drillstring, divided by the bulk modulus of the fluid. For a water based drilling fluid, and a pipe with a mean inner radius of 2 inches (50.8 mm), the compliance will be roughly $4\times10^{-12}$ $Pa^{-1}$ per meter of drillstring. Oil based drilling fluids are generally 25% to 50% more compliant than water based drilling fluids.

Over most conditions encountered in practice, the frictional pressure drop in the drillstring and the frictional pressure drop at the downhole tool are proportional to the flow velocity squared. $\alpha$, the ratio of the frictional pressure drop in the drillstring (in one direction) to the flow velocity squared, and $\beta$, the ratio of the frictional pressure drop through the downhole tool (e.g. the BHA and drill bit) to the flow velocity squared, are, therefore, generally known or can be determined by techniques familiar to the skilled person.

Formulae for frictional pressure drops along a drillstring can be found in references such as Bourgoyne, Millheim, Chenevert and Young, *Applied Drilling Engineering*, SPE Textbook series, volume 2, 1986, p. 147.

Typically, the bit pressure drop is close to one half of the fluid density, times the square of the fluid velocity through the bit nozzles. Appropriate formulae for other BHA components with significant pressure drops are normally supplied in the component specification sheets.

Approximate solutions can be found to following equations (1) and (2) and boundary condition (3) that describe the variation of fluid volumetric flow rate and pressure along the drillstring with time at low frequencies.

$$\frac{\partial v}{\partial x} = -\lambda \frac{\partial P}{\partial t} \tag{1}$$

$$\frac{\partial P}{\partial x} = -f \frac{1}{2} v^2 \tag{2}$$

$$P(L) = \beta \frac{1}{2} v(L)^2 \tag{3}$$

where v if the volumetric flow rate, P is the pressure, is the compliance per unit length, and f is a friction coefficient. The distance along the drillstring from the top is x, the time variable t, and the total drillstring length L. n terms of the parameter, for a constant cross-section drillstring:

$$fL=\alpha \tag{4}$$

Expressions (1) to (3) can be solved exactly for abrupt changes in the flow rate at surface, if the constant is zero. Using this exact solution, a series expansion solution in powers of (~)can be iteratively derived, yielding an expression (5) for a characteristic time τ for the circulating fluid to respond to changes in flow velocity:

$$T = \frac{\tau}{2}\left(1 + \frac{\alpha}{2\beta} + \frac{1}{c}\right) \tag{5}$$

where T is the time for the flow at the downhole tool to reach zero on cessation of pumping of fluid into the borehole, and c is the real solution to the following equation:

$$0 = c(1-c) - \left(\frac{\alpha}{\beta}\right)\left(\frac{c^2}{2} - \frac{c^3}{3} + \frac{c^4}{12}\right) + \left(\frac{\alpha}{\beta}\right)^2\left(\frac{c^3}{12} - \frac{c^4}{12} + \frac{c^5}{36} - \frac{c^6}{252}\right) - \left(\frac{\alpha}{\beta}\right)^3\left(\frac{c^4}{72} - \frac{c^5}{63} + \frac{5c^6}{672} - \frac{5c^7}{3024} + \frac{c^8}{6048}\right) + \left(\frac{\alpha}{\beta}\right)^4\left(\frac{c^5}{504} - \frac{25c^6}{9072} + \frac{29c^7}{18144} - \frac{c^8}{2016} + \frac{c^9}{12096} - \frac{c^{10}}{157248}\right) \tag{6}$$

For a given borehole and downhole tool, T is proportional to the mean flow rate of fluid on which the variations are to be superimposed. Having determined Λ, α, β and τ, a pump flow sequence can be established. One approach is to model the fluid system as a series of n sections in series, at each section the difference between the fluid flow out of and into the section being balanced by the product of the fluid compliance within the section and the pressure change across the section. This is a numerical approximation to the set of analytic equations (1) to (3). The flow can be non-dimensionalised by dividing by the higher of the start and end flow of the pump sequence. Further, time can be expressed in terms of the characteristic time τ.

This approach provides a set of n differential equations which can be solved by iterative simulation.

The pressure drop along the pipe, instead of being regarded as a continuous pressure drop with length, is modelled as a set of discrete pressure drops along the drillstring. Between these pressure drops, the volume flow rate and pressures will be the same. Thus instead of continuous volume flow rate and pressures variables, if there are n pressure drops, there will be n+1 different flow rates in the different sections, and similarly there will be n+1 different pressures.

Using equations (2) and (3), the pressures may be written in terms of the volume flow rates, thus for example:

$$P(L) = \beta\frac{1}{2}v(L)^2 \tag{7}$$

$$P\left(\frac{(n-1)L}{n}\right) = P(L) + \frac{fL}{2n}v\left(\frac{(n-1)L}{n}\right)^2 = \beta\frac{1}{2}v(L)^2 + \frac{fL}{2n}v\left(\frac{(n-1)L}{n}\right)^2 \tag{8}$$

-continued $$P\left(\frac{(n-2)L}{n}\right) = P\left(\frac{(n-1)L}{n}\right) + \frac{fL}{2n}v\left(\frac{(n-2)L}{n}\right)^2 = \beta\frac{1}{2}v(L)^2 + \frac{fL}{2n}v\left(\frac{(n-1)L}{n}\right)^2 + \frac{fL}{2n}v\left(\frac{(n-2)L}{n}\right)^2 \tag{9}$$

etc.

Substituting into equation (1), and integrating gives:

$$v(L) - v\left(\frac{(n-1)L}{n}\right) = -\frac{1}{n}Bv(L)\frac{dv(L)}{dt} \tag{10}$$

$$v\left(\frac{(n-1)L}{n}\right) - v\left(\frac{(n-2)L}{n}\right) = -\frac{1}{n}Bv(L)\frac{dv(L)}{dt} - \frac{1}{n}Av\left(\frac{(n-1)L}{n}\right)\frac{d}{dt}v\left(\frac{(n-1)L}{n}\right) \tag{11}$$

$$v\left(\frac{(n-2)L}{n}\right) - v\left(\frac{(n-3)L}{n}\right) = -\frac{1}{n}Bv(L)\frac{dv(L)}{dt} - \frac{1}{n}Av\left(\frac{(n-1)L}{n}\right)\frac{d}{dt}v\left(\frac{(n-1)L}{n}\right) - \frac{1}{n}Av\left(\frac{(n-2)L}{n}\right)\frac{d}{dt}v\left(\frac{(n-2)L}{n}\right) \tag{12}$$

etc.

The constants A and B which appear in the equations are given by:

$$A = \frac{\alpha}{2\beta + \alpha} \text{ and } B = \frac{2\beta}{2\beta + \alpha} \tag{13}$$

The number of sections necessary to model the actual flow depends on the ratio of A to B. Taking (n−1) as the smallest integer greater than A/B has been found to give good results.

The differential equations are discretised, with the surface flow rate, v(0), at time zero set to a changed flow from the pumps, and the flow rate in the rest of the system at time zero being set at an initial value which typically corresponds to a steady state flow circulating through the system before the flow from the pump is changed. The discretised equations are then integrated in time, with an integration step of 1% of the characteristic time, τ, being sufficiently small to generally provide accurate results.

We have found that typically the fastest way to achieve a flow reduction transition downhole is to reduce the flow rate into the borehole as low as permitted, and then to bring the flow back to the level corresponding to steady state flow at the reduced flow rate. In order to optimise this transition, the time over which the flow into the borehole undershoots the steady state flow at the reduced flow rate is adjusted so that the flow downhole does not quite go below the reduced flow rate for the transition.

Similarly, for a flow increase transition downhole, the flow into the borehole is initially adjusted to as high a level as permitted, and then brought back to the level corresponding to steady state flow at the increased flow rate. Again, for an optimal transition, the time over which the flow into the borehole overshoots the steady state flow at the increased flow rate is adjusted so that the flow downhole does not quite go above the increased flow rate for the transition.

FIG. 1 shows surface flow rates against time for a conventional downlinking flow sequence (dashed line) and a downlinking flow sequence according to the present invention (solid line). In the conventional sequence, the flow is reduced to 75% of the initial level, held at that level and then increased to 100% of the initial level. In the flow sequence according to the present invention, the flow reduction transition is replaced by an undershoot to 50% of the initial level before increasing to the 75% steady state level for the reduced flow, and the flow increase transition is replaced by an overshoot to the 125% level before reducing to the 100% steady state level for the increased flow.

Figure 2:
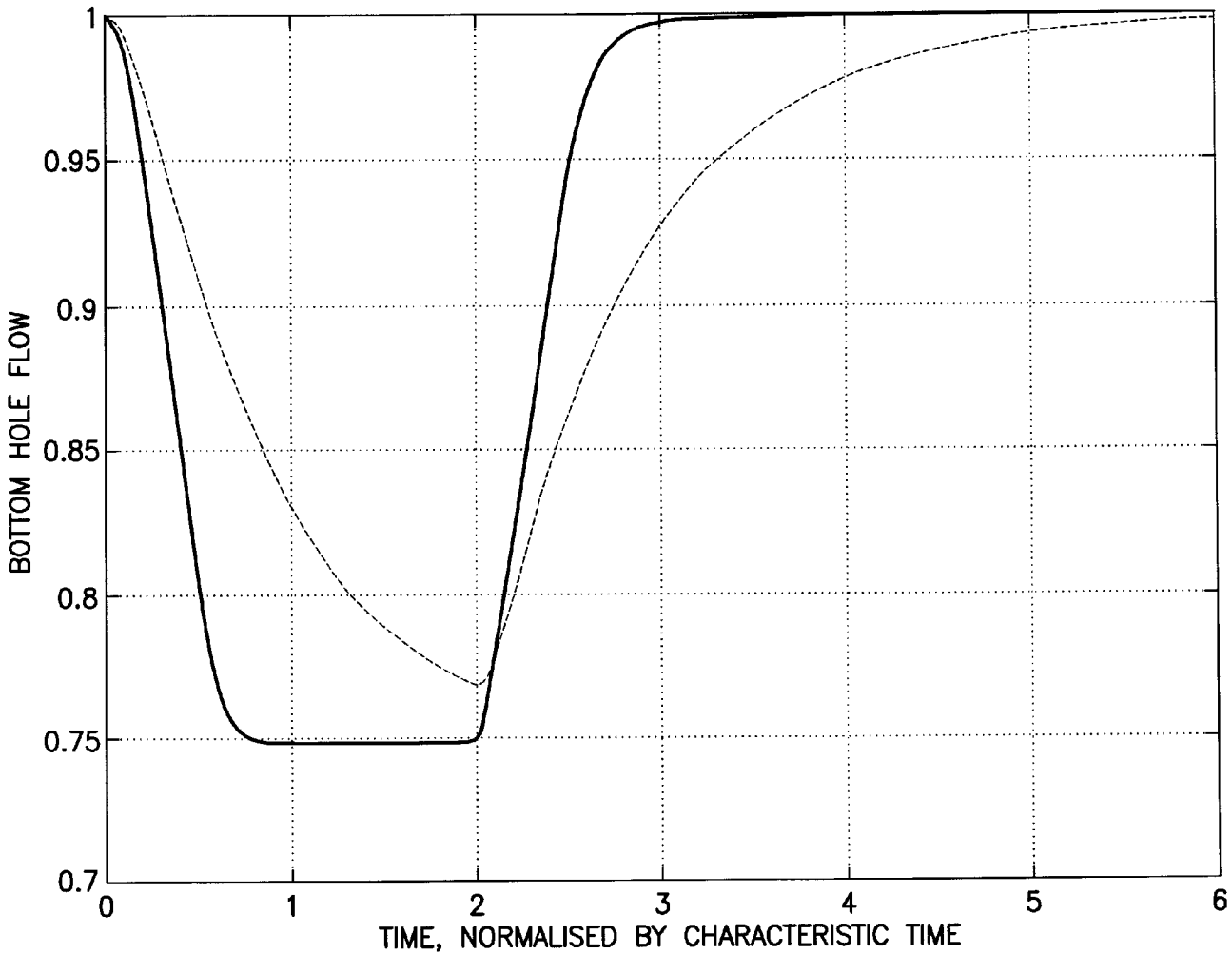
FIG. 2 shows predicted flow rates against time at a downhole tool for the conventional downlinking flow sequence (dashed line) and the downlinking flow sequence according to an embodiment of the present invention (solid line) of FIG. 1.
Figure 3:
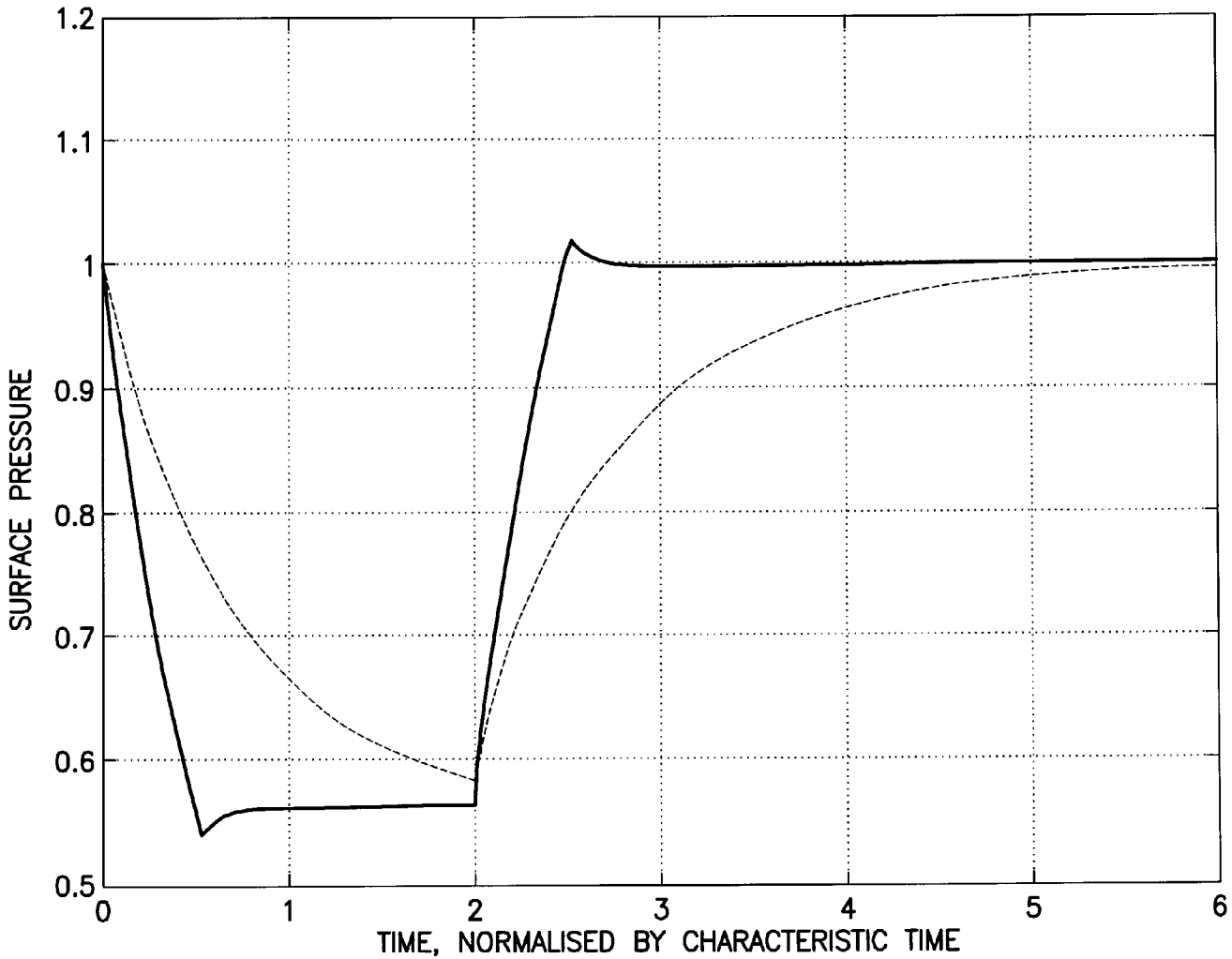
FIG. 3 shows predicted surface pressure against time for the conventional downlinking flow sequence (dashed line) and the downlinking flow sequence according to an embodiment of the present invention (solid line) of FIG. 1.

The surface flow rates of FIG. 1 were used in the iterative simulation described above. FIG. 2 shows predicted flow rates against time at the downhole tool for the conventional downlinking flow sequence (dashed line) and the downlinking flow sequence according to the present invention (solid line), and FIG. 3 shows predicted surface pressure against time for the conventional downlinking flow sequence (dashed line) and the downlinking flow sequence according to the present invention (solid line). The simulation assumed a drillstring pressure drop equal to the downhole tool pressure drop (i.e. $\alpha$ equal to $\beta$), and used a two pressure drop model, (i.e. n=2, and a set of three equations that was solved numerically).

From FIG. 2, it is evident that the target downhole flow rates for both the flow reduction and flow increase transitions are achieved much more rapidly for the downlinking flow sequence using the undershoot and overshoot than for the conventional flow sequence.

FIG. 3 shows that despite the much larger changes in surface flow rates associated with the downlinking flow sequence using the undershoot and overshoot, the surface pressures do not drop excessively below (in the case of the undershoot) or excessively above (in the case of the overshoot) the steady state surface pressures at respectively the 75% and 100% flow levels. This is particularly significant in relation to the overshoot, as drilling operators generally aim to avoid upward pressure spikes which they associate with dangerous drilling conditions that might fracture underground formations or exceed the pressures ratings of components in the surface hydraulic system.

A computerised control system may be provided which calculates optimal downlinking transitions by applying $\Lambda$, $\alpha$, $\beta$ and $\tau$ for a particular borehole to the iterative simulation described above, the simulation taking account of site-specific factors, such as minimum and maximum acceptable surface flow rates and pressures. The system can then be used to automatically control surface pumps during downlinking.

Furthermore, having downlinked, the actual surface pressure can be measured and compared to the predicted values, and adjustments made to the downlinking parameters, either to increase the over or undershoot if the actual surface pressure variations are lower than predicted, or to decrease the over or undershoot if the actual surface pressure variations are higher than predicted.

Figure 4:
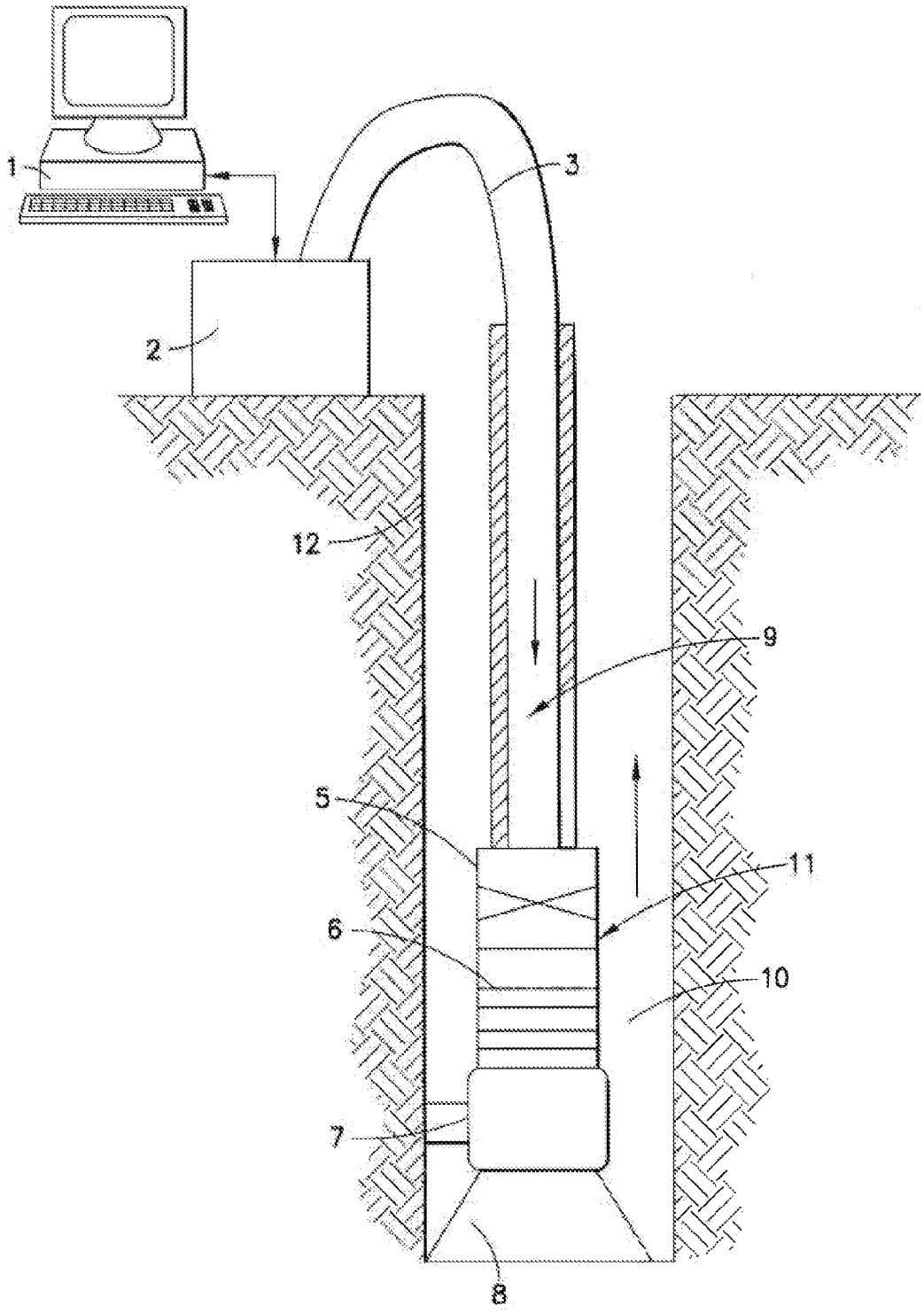
FIG. 4 shows schematically a well having a computerised control system for controlling surface pumps during downlinking, in accordance with an embodiment of the present invention.

FIG. 4 shows schematically a well having such a computerised control system. Mud pumps 2, under the control of computer 1, pump drilling fluid through surface pipework 3 connected to a drillstring 9 in well borehole 12. A BHA 11 at the downhole end of the drillstring comprises components such as a measurement-while-drilling transmitter 5, a logging-while-drilling tool 6 and a rotary steerable system 7. The BHA connects to a bit 8. As indicated by the arrows, drilling fluid flows down through the drillstring 9, the BHA 11, the bit 8 and back up to the surface through annulus 10. As described above, computer 1 downlinks to the BHA 11 by controlling the pumping rate of mud pumps 2 to produce transitions which are detected by the BHA 11.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A method of downlinking to a downhole tool located in a borehole, wherein the downhole tool detects transitions in the flow velocity of fluid circulating in the borehole at the downhole tool, the method including the steps of:

(a) pumping fluid into a drillstring to circulate fluid in the borehole at the downhole tool;

(b) increasing the pumping rate of fluid into the drillstring to a rate which overshoots a steady state pumping rate needed to produce a transition which the downhole tool will detect, or decreasing the pumping rate of fluid into the drillstring to a rate which undershoots the steady state pumping rate needed to produce a transition which the downhole tool will detect, wherein prior to increasing or decreasing the pump rate said steady state pumping rate and said increased or decreased pumping rate are calculated based on a characteristic time for the circulating fluid to respond to changes in pumping rate and any one or any combination of: a compliance per unit length of the fluid circulating within the drillstring, a frictional pressure drop in the drillstring, and a ratio of the frictional pressure drop at the downhole tool, and wherein said characteristic time is determined by temporarily stopping the pumping of fluid into the drillstring; and (c) subsequently adjusting the pumping rate of fluid into the drillstring to approach or achieve said steady state pumping rate;

wherein steps (b) and (c) produce a transition which is detected by the downhole tool.

2. A method according to claim 1, wherein steps (b) and (c) are performed twice in sequence, firstly for one of overshoot and undershoot, and secondly for the other of overshoot and undershoot.

3. A method according to claim 1, wherein steps (b) and (c) are performed repeatedly to produce corresponding transitions which are detected by the downhole tool.

4. A method according to claim 1, wherein said increased or decreased pumping rate is optimised within operational limits associated with the borehole to minimise a time required to effect the detected transition.

5. A method according to claim 1, wherein the downhole tool alters its mode of operation of the downhole tool as a result of detecting the transition or transitions.

6. A method according to claim 1, wherein the downhole tool includes a rotary steerable system.

7. A method according to claim 1, wherein the downhole tool includes a logging-while-drilling or measurement-while-drilling tool.

8. A method according to claim 1, wherein the downhole tool includes a mud-pulse telemetry transmitter.

9. A computer system for controlling a pumping system that pumps fluid into a drillstring to circulate fluid to a downhole tool located in a borehole, and being operable to effect transitions in the flow velocity of the circulating fluid which are detectable at the downhole tool to enable downlinking to the downhole tool;

the computer system being adapted to calculate:

(a) a steady state pumping rate into the drillstring needed to produce a transition which the downhole tool will detect, and (b) either an increased pumping rate of fluid into the drillstring which overshoots said steady state pumping rate, or a decreased pumping rate of fluid into the drillstring which undershoots said steady state pumping rate; wherein:

said steady state pumping rate and said increased or decreased pumping rate are calculated based on a characteristic time for the circulating fluid to respond to changes in pumping rate and any one or any combination of: a compliance per unit length of the fluid circulating within the drillstring, a frictional pressure drop in the drillstring and a ratio of the frictional pressure drop at the downhole tool, and wherein said characteristic time is determined by temporarily stopping the pumping of fluid into the drillstring the computer system further being adapted to issue control signals for controlling the pumping system to:

(i) adjust the pumping rate to said increased or decreased pumping rate, and (ii) subsequently adjust the pumping rate of fluid to approach or achieve said steady state pumping rate;

wherein, in use, the adjustments produce a transition which is detectable by the downhole tool.

10. A system according to claim 9, wherein the computer system is adapted to perform further calculations and to issue corresponding further control signals for controlling the pumping system, so that further transitions can be produced which are detectable by the downhole tool.

11. A system according to claim 9, wherein the computer system is adapted to receive operational limits associated with the borehole, and the calculated increased or decreased pumping rate is optimised within said operational limits to minimize a time required to effect the detectable transition.

12. A pumping system for a borehole, the pumping system comprising a pump for pumping fluid into the borehole through a drillstring and having the computer system according to claim 9 for enabling downlinking to a downhole tool located in the borehole.

* * * * *